United States Patent [19]

Maroszek

[11] 4,266,713

[45] May 12, 1981

[54] UNITARY DOUBLE CAVITY CARTON

[75] Inventor: Raymond V. Maroszek, Neenah, Wis.

[73] Assignee: American Can Company, Greenwich, Conn.

[21] Appl. No.: 88,637

[22] Filed: Oct. 26, 1979

[51] Int. Cl.[3] ..... B65D 5/26; B65D 5/66

[52] U.S. Cl. ..... 229/33; 229/36; 229/44 R

[58] Field of Search ..... 229/30, 33, 34 R, 44

[56] References Cited

U.S. PATENT DOCUMENTS

| | | | |
|---|---|---|---|
| 1,826,962 | 10/1931 | Spare | 229/33 UX |
| 2,887,389 | 5/1959 | Linville | 229/33 UX |
| 3,038,650 | 6/1962 | Asman | 229/33 |
| 3,084,843 | 4/1963 | Urban | 229/30 X |
| 3,232,518 | 2/1966 | Williamson | 229/44 R |
| 3,825,169 | 7/1974 | Meyers | 229/34 R X |
| 3,968,922 | 7/1976 | Ruud | 229/33 |
| 4,232,816 | 11/1980 | Johnson et al. | 229/33 |

*Primary Examiner*—Davis T. Moorhead

*Attorney, Agent, or Firm*—Robert P. Auber; Ernestine C. Bartlett; Ira S. Dorman

[57] ABSTRACT

Unitary double cavity cartons, for example, of the type commonly referred to as clam shell cartons, are provided in which lines of weakness, adjacent the center hinge and positioned to form a hinge ridge or channel upon closing, permit the carton to open freely without buckling or tearing.

25 Claims, 14 Drawing Figures

FIG.1
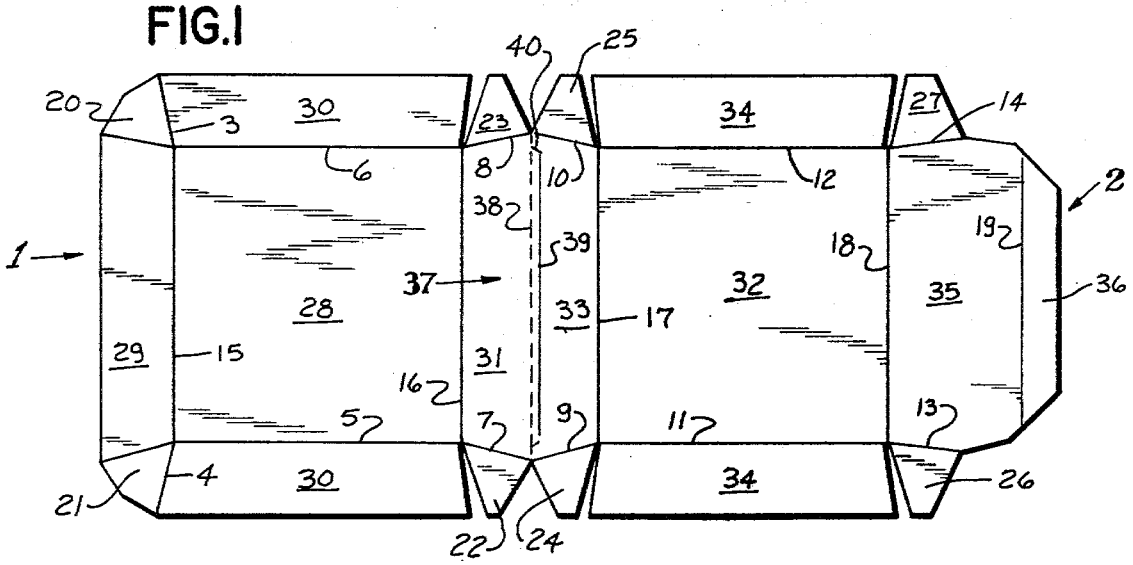
FIG.2
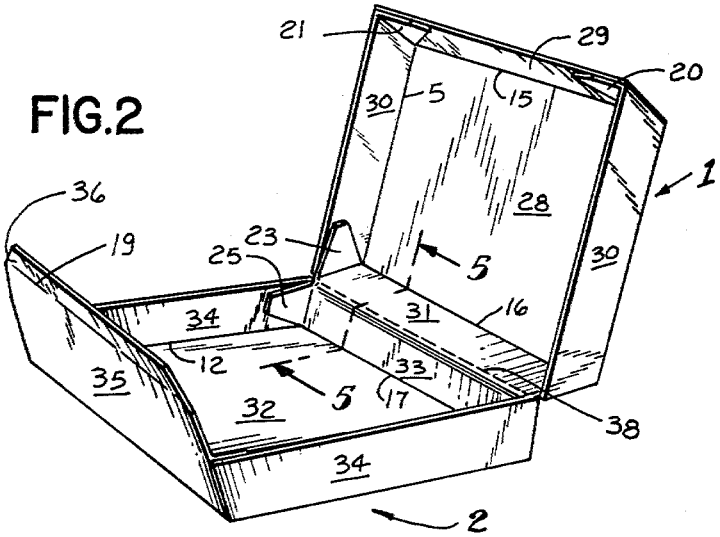
FIG.5
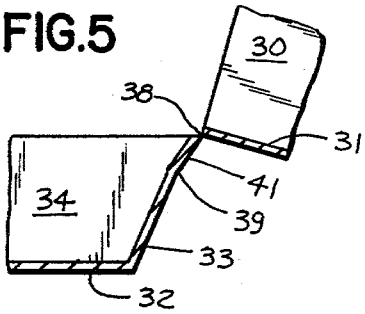
FIG.3
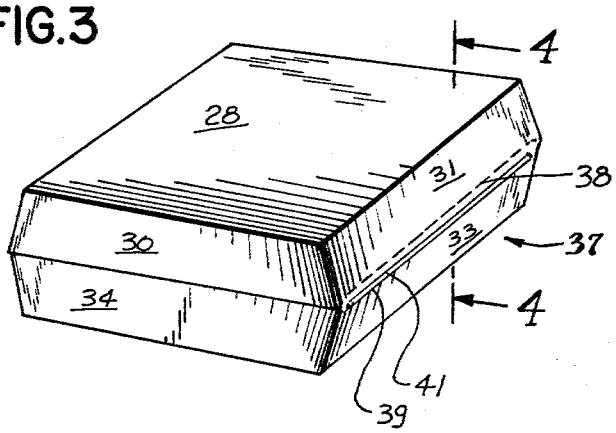
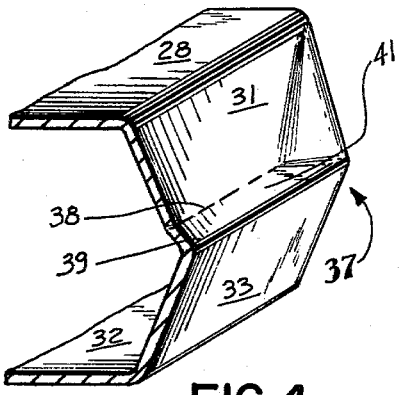
FIG.4

UNITARY DOUBLE CAVITY CARTON

BACKGROUND OF THE INVENTION

1. Prior Art

The prior art appears to be best exemplified by the following patent: Persson, U.S. Pat. No. Des. 244,833 dated 6/28/77.

2. Field of the Invention

Double cavity trays of the general type contemplated by this invention are familiar items of commerce. Such "clam shell" type cartons are popularly used in the packaging of hamburgers and other items sold at fast-food, carryout facilities, for example. One such carton is illustrated in U.S. Pat. No. Des. 244,833 and is conveniently formed from unitary scored blanks of a suitable material such as paper or paperboard folded along fold lines to present a bottom tray portion and a top tray portion hingedly connected at the respective rear walls through a center hinge. Such blanks are assembled into cartons simply by adhering suitable glue tabs to erect the top and bottom tray cavities and then folding the top tray portion over the bottom tray portion via the center hinge on the rear wall.

One problem encountered with such cartons has been their tendency to buckle and prevent easy opening. The construction of such cartons involves a substantial space between the rear wall hinge and the opening feature at the front of the carton. This space, coupled with the somewhat flexible nature of the paperboard, results in a tendency in the carton to flex or fold when the top cover portion is lifted and folded back causing the rear wall to bow outwardly and buckle instead of readily folding back on the center hinge. It often happens that further attempts to lift the top cover while the carton is in such buckled and/or outwardly bowed condition results in tearing of the top cover at the center hinge thus impairing and even destroying in some instances any reclosure feature that may be present.

This invention relates to blanks and cartons constructed therefrom of the double cavity, clam shell type. A particular object of the invention is the provision of a construction that is easily opened because it is free of buckling and/or bowing and that is recloseable after opening.

SUMMARY OF THE INVENTION

The above and other objects of the invention are realized in the carton of the invention wherein the rear wall is stabilized against buckling and/or bowing outwardly by provision of lines of weakness so positioned relative to the center hinge as to create a hinge ridge or channel upon closing the carton. Such a hinge ridge is formed upon closing the carton provided with at least one line of weakness on either side of the center hinge or, alternatively, by a center hinge line having its central portion comprises of an offset cut score. Such a hinge channel is formed upon closing the carton provided with at least one line of weakness on each side of the center hinge.

The lines of weakness may be in the form of perforations, cut scores, half scores, knife cuts, creases or combinations thereof. Similarly, the lines of weakness may be either entirely parallel to the center hinge or they may be partially parallel with either end portion or central portions thereof at acute, obtuse or right angles relative to the crease line. Combinations of such features may likewise be employed.

In the preferred embodiment of the invention, the center hinge line is perforated and extends substantially the entire length of the rear wall. A cut score adjacent and parallel to the center hinge and substantially coextensive therewith, is formed above the center hinge. When the carton is closed, the cut score opens to some extent to strengthen the rear wall forming a hinge ridge and cooperates with the center hinge to define a hinge ridge area between which folding occurs without outward bowing or buckling when the carton is opened. Additionally, in the preferred embodiment, the bottom cavity front panel has a fold back extension or a bridging panel adapted to be wedged between the top front panel and the bottom front panel. The edges of the bridging panel are preferably angled to complement the angled edges of the glue tabs adhered to the top front panel, the complementary edges being in abutting edge relation in the closed carton to enhance the locking feature of the reclosable carton.

BRIEF DESCRIPTION OF THE DRAWINGS

FIG. 1 is a plan view of the outside of a paperboard carton blank comprising a preferred embodiment of this invention;

FIG. 2 is a perspective view of the set up carton ready to receive product.

FIG. 3 is a side view of the closed carton showing the rear and side walls.

FIG. 4 is a partial sectional view taken along line 4—4 of FIG. 3 showing the rear wall center hinge and cut score lines and the hinge ridge formed in the closed carton.

FIG. 5 is a partial sectional view taken in the same plane of FIG. 4 showing the rear wall center hinge and cut score lines and hinge ridge in the opened carton.

DETAILED DESCRIPTION OF THE PREFERRED EMBODIMENT

Figure 6:
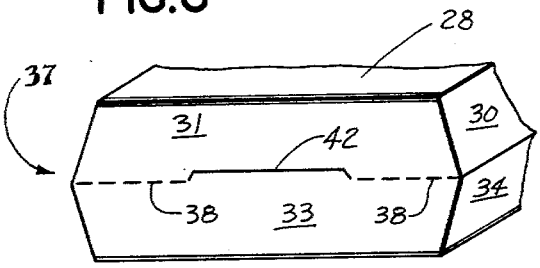
FIG. 6 is a partial view of the rear wall of a modification of the embodiment of FIG. 1.

The carton of the invention is formed of a blank of paperboard of similar material, for example as shown in the embodiment illustrated in FIG. 1 which illustrates the outside of the blank to more clearly show the rear wall scoring. The blank comprises a top 1 (corresponding to the top tray in the erected carton) and a bottom 2 (corresponding to the bottom tray in the erected carton), both suitably scored with fold lines 3–19 and comprising glue tabs 20–27. The top 1 comprises a top wall panel 28 hingedly connected to front wall panel 29, sidewall panels 30 and rear wall panel 31 through fold lines 5, 6, 15 and 16. Similarly, the bottom 2 comprises a top wall panel 32, rear wall panel 33, sidewall panels 34 and front wall panel 35, hingedly connected to bottom panel 32 through fold lines 11, 12, 17 and 18. Front panel 35 is connected through fold line 19 to bridging panel 36. The carton rear wall 37 is comprised of top rear wall panel 31 and bottom rear panel 33 hingedly connected through center hinge 38. Cut score line 39 runs parallel and adjacent to the center hinge 38 terminating in ends 40 that are angled toward the center hinge.

In forming the carton of the invention from the blank just described the blank illustrated in FIG. 1 is turned over to the other side since the outside of the blank is illustrated in the Figure. The respective glue tabs 20 to 27 and the respective wall panels 28 to 35 are folded in on fold lines 3 to 18. A suitable adhesive (not shown) is applied to the glue tabs which are in turn adhered to the respective sidewall panels 30 and 34. The bridging panel 36 is folded outwardly on hinge line 19. The erected carton appears as shown in FIG. 2 in which position it may be filled with product.

The carton is closed by swinging top tray cavity portion 1 over the bottom tray cavity portion 2 along the center hinge 38. The bridging panel 36 is inserted inside the front wall 29 of top cavity 1 to lie sandwiched between the front wall 29 and the bottom cavity front wall 35 thus providing a wedging, locking function. Preferably, the edges of bridging panel 36 are angled to be complementary to the angled edges of glue tabs 20 and 21, the complementary angled edges being in abutting relationship in the closed carton. The closed carton is illustrated in FIG. 3.

In closing the carton from the position illustrated in FIG. 2 to the closed position illustrated in FIG. 3, force applied in folding the top cavity portion 1 over the bottom cavity portion 2 results in the opening of center hinge 38 and in some degree of opening of the cut score 39 to form a hinge ridge 41, i.e., an area between the cut score line 39 and center hinge 38 and defined thereby. Upon opening the carton folding occurs within the hinge ridge without buckling, bowing or tearing. The hinge ridge 41 may best be seen in FIGS. 4 and 5 which illustrate the hinge-cut score area of the carton rear wall 37 before and after opening of the carton. The carton may be readily reclosed by swinging the top tray cavity over the bottom tray cavity and inserting the bridging panel as described above. Such recloseable feature is particularly desirable since it provides protection for partially consumed products or for other uses, as desired.

In an alternative embodiment illustrated in FIG. 6, a hinge ridge may be formed by interrupting the center portion of center hinge 38 with an offset knife cut 42 which functions, upon closing the carton, to form a ridge substantially equivalent in function to that described hereinabove.

Figure 8:
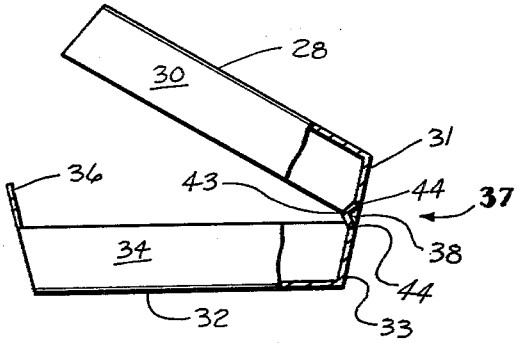
FIG. 8 is a side view of the carton of FIG. 7 with rear portions broken away to show a section of the hinge channel when the carton is opened.
Figure 7:
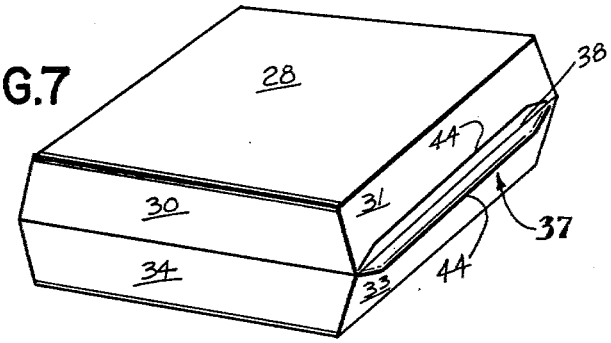
FIG. 7 is a perspective view illustrating another embodiment of the invention and showing a rear wall construction in a closed carton wherein a hinge channel is formed by lines of weakness on each side of the center hinge.
Figure 9:
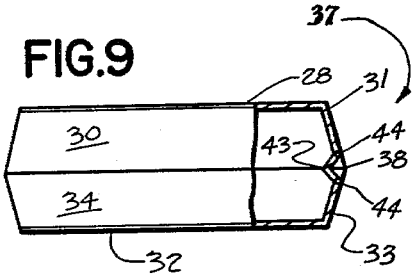
FIG. 9 is a view similar to that shown in FIG. 8 with rear portions broken away to show a section of the hinge channel when the carton is closed.
Figure 10:
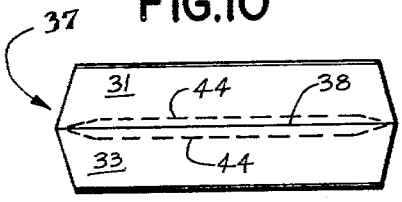
FIGS. 10 to 14 are views showing modifications of the embodiment of FIG. 7 wherein hinge channels are formed by various arrangements of lines of weakness relative to the center hinge line.
Figure 13:
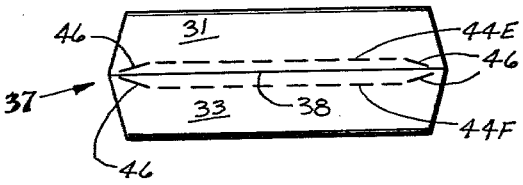
Figure 11:
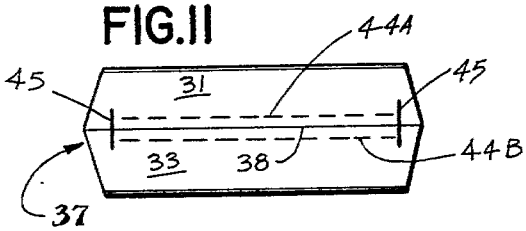
Figure 14:
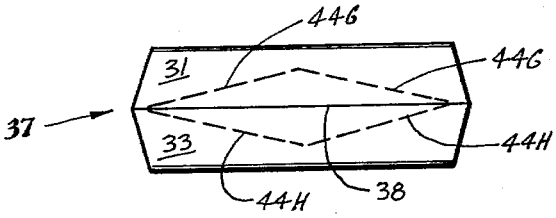
Figure 12:
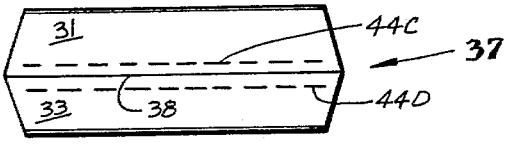

As illustrated in FIGS. 7 to 9, carton rear wall 37 may be stabilized against buckling, tearing and bowing outwardly by alternative modified embodiments of the invention. As illustrated, a hinge channel 43 may be formed upon closing the carton through the placement of a line of weakness on each side of the center hinge 38. Thus in the modification illustrated in FIGS. 7 to 9, and modifications thereof as illustrated in FIGS. 10 to 14, perforations 44 are formed on each side of center hinge 38 and are tapered or angled in toward the center hinge at their respective end portions. In this embodiment, upon closing the carton, the perforations 44 open to some extent and in cooperation with center hinge 38, are effective to form an inverted hinge channel 43 in which area folding is confined without buckling or bowing. Such action is best seen in FIGS. 8 and 9 which illustrate in sectional view these aspects of the invention.

The hinge channel 43 may be formed employing a variety of forms and configurations for the lines of weakness which may be cut scores, creases, perforations, knife cuts, etc., as disclosed earlier herein in the description relative to the embodiment of FIG. 1. In the modified version of the invention illustrated in FIG. 10, straight line perforations 44 are formed on each side of center hinge 38 and are tapered in toward the center hinge line at their respective end portions. In the modified version illustrated in FIG. 11, straight line perforations 44A and 44B are formed on each side of center hinge 38 and are terminated by vertical knife cuts 45 which extend from the end of perforation 44A to the end of perforation 44B. In the modified version of the invention illustrated in FIG. 12, straight line perforations 44C and 44D extend to the outer edges of the top cavity rear panel and the bottom cavity rear panels, respectively. In the modified version illustrated in FIG. 13, straight line perforations 44E and 44F extend to angled knife cuts 46. Finally, in the modified version of FIG. 14, the perforated lines 44G and 44H extend outwardly from the center hinge 38 toward the respective rear wall and are then extended in reverse direction toward the center hinge line.

It will be evident from the above description that this invention provides a carton construction with uniquely effective means in the rear wall to strengthen the rear wall and to prevent buckling and outward bowing through lines of weakness positioned relative to said center hinge to provide either a hinge ridge or hinge channel in which said folding may be confined. It is understood that minor variations of the preferred embodiments herein disclosed may be made without departing from the spirit of the invention.

I claim:

1. In a double cavity paperboard carton formed of a single cut and scored blank having a bottom cavity portion and a top cavity portion wherein each of the bottom and top cavities comprise hingedly connected front, side and rear walls adhered through suitable glue tabs, and the top and bottom cavities are hingedly connected through a center hinge line connecting their respective rear walls, the improvement which comprises provision of a fold area on said carton rear wall adjacent said center hinge line within which folding is controlled without buckling or outward bowing, said area being selected from the group consisting of (1) a hinge ridge defined by a member selected from (a) at least one line of weakness adjacent and parallel to said center hinge on either side thereof; and (b) an offset cut score or knife cut at the center of said center hinge; and (2) a hinge channel defined by at least one line of weakness on each side of said center hinge.

2. The carton of claim 1 wherein said fold area is a hinge ridge defined by a single line of weakness adjacent the center hinge and extending substantially the entire length of the center hinge in parallel relationship therewith.

3. The carton of claim 1 wherein said fold area is a hinge ridge defined by an offset knife cut in the center of said hinge line.

4. The carton of claim 2 wherein said line of weakness defining said hinge ridge and hinge channel is present in the form of a member selected from the group of perforations, cut scores, creases, knife cuts and combinations thereof.

5. The carton of claim 4 wherein said center hinge is a perforated line extending substantially the entire length of the carton rear wall and said line of weakness is a single cut score adjacent and parallel to said center hinge, the ends of said cut score being angled toward the ends of said perforated center hinge.

6. The carton of claim 3 wherein said center hinge is a perforated line.

7. The carton of claim 1 wherein said fold area is a hinge channel defined by at least one line of weakness on each side of said center hinge.

8. The carton of claim 7 wherein said center hinge is a perforated line extending substantially the entire length of the carton rear wall and said line of weakness is present in the form of a member selected from the group of perforations, cut scores, creases, knife cuts and combinations thereof.

9. The carton of claim 8 wherein said line of weakness on each side of said center hinge is in the form of perforations.

10. The carton of claim 9 wherein the ends of said perforated lines on each side of the center hinge are angled toward the center hinge.

11. The carton of claim 9 wherein said perforated lines on each side of the center hinge terminate at knife cuts that extend vertically from one perforated line to the other.

12. The carton of claim 9 wherein said perforated lines on each side of the center hinge are terminated by knife cuts angled toward said center hinge.

13. The carton of claim 9 wherein said perforated lines on each side of the center hinge extend continuously from a point adjacent the center hinge to a center point adjacent the outer edge of the rear wall to a point adjacent the center hinge.

14. A recloseable double cavity paperboard carton formed of a single cut and scored blank having a bottom cavity portion and a top cavity portion each comprising hingedly connected front, side and rear walls adhered through suitable glue tabs; the bottom and top cavities being hingedly connected through a center hinge line joining the respective rear walls; the bottom front wall comprising a bridging panel hingedly connected along a line of weakness to its lower edge and folded outwardly to lie sandwiched between the top and bottom cavity front wall when the carton is closed; the carton rear wall comprising a fold area adjacent said center hinge within which folding is controlled without buckling or outward bowing, said fold area comprising a single cut score adjacent and parallel to the center hinge, said cut score extending substantially the entire length of the center hinge and cooperating with said center hinge to form a hinge ridge when the carton is closed.

15. A recloseable double cavity formed of a single cut and scored blank having a bottom cavity portion and a top cavity portion, each comprising hingedly connected front, side and rear walls adhered through suitable glue tabs, the bottom and top cavities being hingedly connected through a center hinge line joining the respective rear walls; the bottom front wall comprising a bridging panel hingedly connected along a line of weakness to its lower edge and folded outwardly to lie sandwiched between the top and bottom cavity front walls when the carton is closed; the carton rear wall comprising a fold area adjacent said center hinge within which folding is controlled without buckling or outward bowing, said fold area comprising a member selected from the group of perforated lines and cut score lines and combinations thereof adjacent to the center hinge and disposed on each side thereof, said member extending substantially the entire length of the center hinge and cooperating with said center hinge to form a hinge channel when the carton is closed.

16. In a one-piece paperboard carton blank adapted to be formed into a double cavity carton having a bottom cavity portion and a top cavity portion each comprising hingedly connected front, side and rear wall panels and wherein the top cavity panel and the bottom cavity panel are hingedly connected through a center hinge in the rear wall panel, the improvement wherein said rear wall panel comprises a fold area adjacent said center hinge line within which folding of the top cavity in the erected carton is controlled without buckling or outward bowing, said area being selected from the group consisting of (1) a hinge ridge defined by a member selected from (a) at least one line of weakness adjacent and parallel to said center hinge on either side thereof and (b) an offset cut score or knife cut at the center of said center hinge; and (2) a hinge channel defined by at least one line of weakness on each side of said center hinge.

17. The carton blank of claim 16 wherein said fold area is a hinge ridge defined by a single line of weakness extending substantially the entire length of the center hinge.

18. The carton blank of claim 16 wherein said fold area is a hinge ridge defined by an offset knife cut in the center of said hinge line.

19. The carton blank of claim 17 wherein said line of weakness defining said hinge ridge and hinge channel is present in the form of a member selected from the group of perforations, cut scores, creases, knife cuts and combinations thereof.

20. The carton blank of claim 19 wherein the center hinge is a perforated line extending substantially the entire length of the rear wall panel and said line of weakness is a single cut score adjacent and parallel to said center hinge, the ends of said cut score being angled toward the ends of said perforated center hinge.

21. The carton blank of claim 16 wherein said fold area is a hinge channel defined by at least one line of weakness on each side of said center hinge.

22. The carton blank of claim 21 wherein the center hinge is a perforated line extending substantially the entire length of the carton rear wall panel and said line of weakness is present in the form of a member selected from the group of perforations, cut scores, creases, knife cuts and combinations thereof.

23. The carton blank of claim 22 wherein said line of weakness on either side of the center hinge is in the form of perforations.

24. The carton blank of claim 23 wherein said perforated lines on each side of the center hinge terminate at knife cuts which either extend vertically from one perforated line to the other or angle toward the center hinge.

25. The carton blank of claim 23 wherein said perforated lines on each side of the center hinge extend continuously from a point adjacent the center hinge to a center point adjacent the outer edge of the rear wall to a point adjacent the center hinge.

* * * * *